United States Patent [19]

Katsuda et al.

[11] Patent Number: 4,969,854

[45] Date of Patent: Nov. 13, 1990

[54] AEROSOL APPLICATOR AND METHOD

[75] Inventors: Yoshio Katsuda; Masuo Matsumoto, both of Hyogo; Yoshihiro Minamite, Osaka; Kazunori Hoshino; Yukio Hachinohe, both of Kanagawa; Iwao Yazawa, Tokyo, both of Japan

[73] Assignee: Dainihon Jochugiku Company Ltd., Osaka, Japan

[21] Appl. No.: 405,594

[22] Filed: Sep. 11, 1989

Related U.S. Application Data

[63] Continuation of Ser. No. 124,836, Nov. 24, 1987, abandoned, which is a continuation of Ser. No. 732,822, Apr. 26, 1985, Pat. No. 4,733,984.

[30] Foreign Application Priority Data

| | | | |
|---|---|---|---|
| Aug. 26, 1983 | [JP] | Japan | 58-131880 |
| Dec. 20, 1983 | [JP] | Japan | 58-195902 |
| Feb. 19, 1984 | [JP] | Japan | 59-29306 |
| Mar. 5, 1984 | [JP] | Japan | 59-41749 |

[51] Int. Cl.[5] ..... B05C 17/00; A47L 13/00; A47L 13/06

[52] U.S. Cl. ..... 401/190; 401/206; 401/207

[58] Field of Search ..... 401/190, 205, 207, 140, 401/139, 196, 206, 266

[56] References Cited

U.S. PATENT DOCUMENTS

| | | | |
|---|---|---|---|
| 844,700 | 2/1907 | Urban | 401/206 |
| 1,267,521 | 5/1918 | Dover | 401/206 |
| 1,545,961 | 7/1925 | Keenan | 401/206 |
| 1,594,967 | 8/1926 | Leger | 401/206 |
| 2,110,188 | 3/1938 | Wisner | 401/205 X |
| 2,190,376 | 2/1940 | Daley | 401/118 X |
| 2,211,275 | 8/1940 | Lachapelle | 401/140 X |
| 2,567,764 | 9/1951 | Davies | 401/207 X |
| 2,897,526 | 8/1959 | Dootson | 401/266 |
| 2,998,822 | 9/1961 | Birch et al. | 401/190 |
| 3,008,164 | 11/1961 | Herman et al. | 401/139 X |
| 3,135,990 | 6/1964 | Bergmann et al. | 401/190 X |
| 3,164,856 | 1/1965 | Samaras et al. | 401/190 |
| 3,184,781 | 5/1965 | Hoxie | 401/190 |
| 3,256,549 | 6/1966 | Evesque | 401/190 |
| 3,258,809 | 7/1966 | Harvey | 401/204 X |
| 3,328,830 | 7/1967 | Corwin | 401/196 X |
| 3,343,729 | 9/1967 | Rait | 401/190 |
| 3,565,541 | 2/1971 | Vallis . | |
| 3,685,913 | 8/1972 | Pass | 401/190 |
| 3,722,021 | 3/1973 | Brainerd et al. | 401/190 X |
| 3,850,656 | 11/1974 | Brown | 401/190 |
| 3,973,853 | 8/1976 | Myers | 401/190 |
| 4,074,944 | 2/1978 | Xavier . | |
| 4,078,865 | 3/1978 | Moser | 401/140 X |
| 4,089,609 | 5/1978 | Gring et al. | 401/190 X |
| 4,492,223 | 1/1985 | Burke | 401/190 |
| 4,733,984 | 3/1988 | Katsuda et al. | 401/190 |

FOREIGN PATENT DOCUMENTS

| | | | |
|---|---|---|---|
| 0037903 | 10/1981 | Fed. Rep. of Germany | 401/190 |
| 422919 | 2/1942 | Japan . | |
| 118664 | 3/1926 | Switzerland | 401/205 |
| 566119 | 7/1975 | Switzerland | 401/190 |
| 1255666 | 12/1971 | United Kingdom . | |
| 1257353 | 12/1971 | United Kingdom . | |
| 1367936 | 6/1972 | United Kingdom | 401/264 |

*Primary Examiner*—Steven A. Bratlie
*Attorney, Agent, or Firm*—Oliff & Berridge

[57] ABSTRACT

Effective application of enough of the contents of an aerosol container to carpets and floor coverings to give thorough extermination of insects and mites infesting such floor coverings is accomplished by the method of this invention, comprising the steps of leading the contents from a stem to an applicator part formed on a lateral side of the aerosol container and allowing the contents to exude from an application face of the applicator part. This method is worked advantageously by an application type aerosol apparatus which comprises an applicator prop disposed in the vertical direction on the outside of the aerosol container, having the applicator part fixed in the longitudinal direction on the outer surface thereof, having a guide chamber for the contents of the aerosol solution formed on the inner surface of the applicator part and a guide inlet communicating with the stem of the aerosol container connected to the applicator prop and adapted to enable the incoming contents to exude from the outer surface of the applicator prop.

11 Claims, 9 Drawing Sheets

AEROSOL APPLICATOR AND METHOD

This is a continuation of application Ser. No. 07/124,836 filed Nov. 24, 1987, now abandoned, which in turn is a continuation application of application Ser. No. 07/732,822 filed Apr. 26, 1985, now U.S. Pat. No. 4,733,984.

BACKGROUND OF THE INVENTION

1. Field of Invention

This invention relates to a method for application characterized by the steps of guiding the liquid contents of an aerosol container through a stem to an applicator part formed on a lateral side of the aerosol container, causing the liquid contents to exude out of an applying face of the applicator part, and applying the exuding liquid on a given surface, to a method for expelling insects from carpets and floorcloths by treating the roots of yarns of the carpets and floorcloths by the aforementioned method for application, and to an application type aerosol apparatus.

2. Background of the Invention

In recent years, changes in living style have encouraged increasing numbers of homes to adopt the practice of spreading carpets directly on concrete or wooden floors, or first placing mats or highly hygroscopic tatamis (straw matting used as a floor covering) directly on such floors and then placing carpets on top of the mats or the tatamis. These floor coverings have fostered the growth of various species of acaroid mites, house dust mites, and cheyletidaes, which not only displease the inhabitants of the house, but also expose them to such diseases as allergic asthma and tetter. Wool carpets and mouton coverings become infested with case-bearing clothes moths and carpet beetles which live on animal hair. The larvae of these harmful insects hide deep in the roots of the carpet yarns, eat into such roots at random, and spoil the carpet's value.

The gradual elevation of living standards has given rise to frequent use of numerous types of agents for external application such as, for example, furniture cleaners, antistatic agents for clothes, phonographic records, and plastic articles, waterproofing agents and stain removers for clothes, softening agents and polishing agents for leather articles, fungistatic agents and deodorants for clothes and leather articles, flameretardants for curtains and wall papers, cleaners and defrosters for glass articles, rustproofing lubricants for sliding doors, lubricants for various sliding surfaces, bactericidal deodorants for sick rooms and sick beds, repellents and insecticides for toy animals, agents for hair care, repellents and insecticides for stuffed animals, and detergents for carpets.

Heretofore, hand pumps and aerosol sprays have prevailed as the means for the application of such agents to carpets and other floor coverings. They, however, entail the following problems:

(1) These devices do not enable their contents, such as insecticides, to reach the roots of the carpet yarns. The contents thus applied, though effective from the preventive point of view, fail to produce the anticipated effects upon mites and harmful insects already inhabiting the carpet.

(2) Since the devices disperse their contents in the surrounding spaces, they may expose their users to the danger of inhaling noxious substances drifting in the air and suffering from loss of health.

(3) Since the devices inevitably permit dispersion of their contents during the course of application, part of the released agents which fail to land on the surfaces under treatment adhere to nearby furniture and fittings to stain their surfaces and smear their surroundings.

(4) When objects under treatment are not smooth flat surfaces, as in articles of felt, for example, the devices are incapable of enabling their contents to reach the roots of raised strings.

As one approach to the solution of these problems, furniture cleaners have been devised which have doughnut-shaped brush caps and sponge adapters fitted around injection spray nozzles. With these devices, users are allowed barely to spray their contents on the surfaces of given objects and then spread the contents deposited on the surfaces with the aid of brushes or sponges separately provided near the spray nozzles of the containers. Thus, these devices are still incapable of overcoming the problems (1)-(4) enumerated above. The surfaces effectively treated by these devices are limited in area and the released agents cannot be spread uniformly.

SUMMARY OF THE INVENTION

In view of the true state of prior art described above, the inventors engaged in a diligent study directed to the development of a method capable of precisely and safely applying the desired active agents on clothes, leather articles, furniture, and carpets. They have found that the spread aerosol method, namely the method comprising the steps of guiding the liquid contents of an aerosol container through a stem to an applicator part formed on the lateral side of the aerosol container, allowing the liquid contents to exude out of the applying surface of the applicator part, and spreading the exuding agent on a given surface permits the safe and effective treatment desired. This knowledge has led to perfection of this invention.

Instead of making use of the conventional adapter fitted around the injection nozzle of the aerosol container for the application of an active agent, such as insecticide or miticide, supplied in an aerosol container, the method of the present invention uses an applicator part formed along the length of a lateral side of the aerosol container, allows the active agent to be released through the applicator part and then deposited on a given surface. The applicator part formed on the lateral side of the aerosol container and the guide means for forwarding the active agent from the stem to the applicator part are not specifically limited in terms of shape.

A method of application such as that of the invention as described above represents a novel concept never anticipated by the conventional method for the application of the contents of an aerosol container.

This invention further relates to an application type aerosol container which is used in effecting the aforementioned method for the application of the active agent, such as insecticide or miticide, held in the aerosol container.

More specifically, this invention provides an apparatus for effecting the application of the active agent held in the aerosol container by guiding the active agent from a stem to an applicator part formed on the lateral side of the aerosol container and causing the active agent to exude out of the application face of the applicator part, which apparatus comprises:

an applicator prop disposed in the vertical direction on the outer side of the aerosol container and adapted to fix the applicator part in the longitudinal direction on the outer surface thereof and, at the same time, form on the inner surface of the applicator part a guide chamber for the active agent held in the aerosol container and a guide inlet interconnecting a stem of the aerosol container and the aforementioned applicator part to form a path enabling the active agent to exude out of the application face of the applicator part.

In application type aerosol apparatus of this invention, the applicator part may be formed of a liquid-absorbing material and the connection of the guide inlet to the applicator prop may be accomplished by opposing the guide inlet to one upper lateral side of a guide prop inserted into the guide chamber through the medium of the inner surface of the guide chamber and the flow space of the active agent.

In one embodiment of this invention, therefore, the application type aerosol apparatus comprises an applicator prop disposed in the vertical direction on the outer side of the aerosol container and adapted to fix the applicator part made of a liquid-absorbing material in the longitudinal direction on the outer surface thereof and form on the inner surface of the applicator part a guide chamber for the active agent held in the aerosol container and a guide inlet connected to a stem of the aerosol container and opposite one upper lateral side of a guide prop inserted into the guide chamber between the inner surface of the applicator part and a flow space for the active agent to enable the active agent brought in through the guide inlet to exude from the outer face of the applicator prop.

Further, in the application type aerosol apparatus, the applicator prop may be produced by forming a trough-shaped receptacle frame closed at the opposite ends in the longitudinal direction thereof and having an opening formed therein and fitting fast in the receptacle frame the applicator part made of a non-absorbent material and having a smooth application face protrude on one side.

In this embodiment of the invention, the application type aerosol apparatus specifically comprises a guide inlet connected to the stem of the aerosol container and opening into a trough-shaped receptacle frame closed at the opposite ends in the longitudinal direction thereof, an applicator part made of a nonabsorbent material, having a smooth application face thereof protruding on one side and fitted fast in the receptacle frame, and a flow space for the active agent interposed between the applicator part and the receptacle frame, so that the active agent brought in through the guide inlet will be allowed to exude from the outer face of the applicator prop.

All of the embodiments described above share the basic operating principle that the active agent held in the aerosol container is moved to an applicator part formed on the lateral side of the aerosol container and then is allowed to exude from the application face of the applicator part. The applicator part formed on the lateral side of the aerosol container and the guide means laid between the stem and the applicator part are not specifically limited in terms of shape.

The application apparatus of the present invention described above represents an entirely novel concept never anticipated by the conventional apparatus developed for the application of the contents of the aerosol container.

The other objects and characteristics of this invention will become apparent from the further disclosure of the invention to be made in the following detailed description of preferred embodiment, with reference to the accompanying drawings.

DETAILED DESCRIPTION OF THE PREFERRED EMBODIMENTS

The present invention will be described more specifically below with reference to the accompanying drawings.

Figure 1:
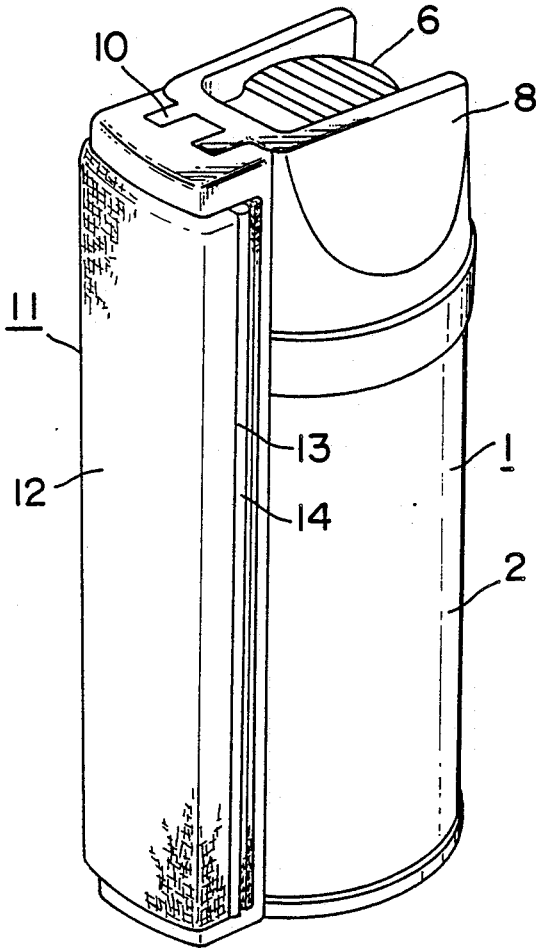
FIG. 1 is a perspective view of one embodiment of an application type aerosol apparatus of the present invention.
Figure 2:
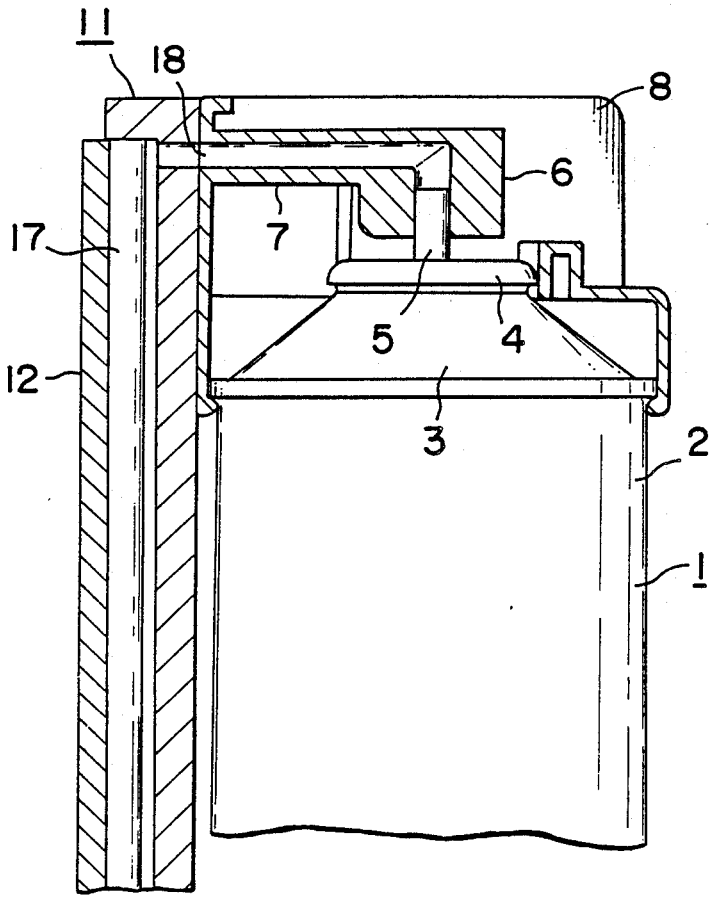
FIG. 2 is an enlarged cross section of part of the apparatus of FIG. 1.
Figure 3:
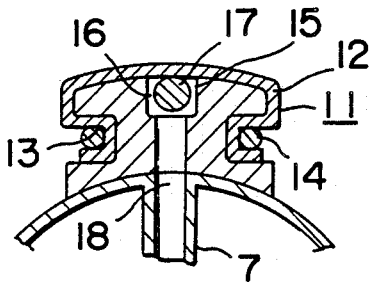
FIG. 3 is a lateral cross section of a portion of the guide inlet in the diagram of FIG. 1.

FIG. 1 is a perspective view of one embodiment of an application type aerosol apparatus of this invention. FIG. 2 is an enlarged cross section of part of the embodiment of FIG. 1. FIG. 3 is a lateral cross section of a portion of the guide inlet in the apparatus of FIG. 1. In the diagrams, an aerosol container 1 is formed of an aerosol unit, a pump type injector, a squeeze bottle unit, etc. To the upper end of a barrel 2, a mounting cup 4 is fixed through the medium of a strap 3. A stem 5 is thrust out of the mounting cup 4. To this stem 5 is connected a pushbutton 6. The pushbutton 6 is constructed so that when it is depressed, the contents, such as insecticide, paint, cleaner, or wax prepared in an applicable form is spurted out through a nozzle 7 by the spurting force of a propellant of accumulated pressure or the pressure generated by a pump mechanism. This nozzle 7 is intergrally formed, through the medium of the external end thereof, with a one-touch cap 8 fixed to the upper end of the aerosol container 1. While the pushbutton 6 is kept down, the nozzle 7 slightly bends out of shape to guide the contents of the aerosol container 1 outwardly. An applicator prop 11 is fixed along substantially the entire length in the vertical direction of the aerosol container 1 through the medium of projected flanges 10 of the one-touch cap 8. This applicator prop 11 carries a sheet-like applicator part 12 made of absorbent material, such as felt, open-cell foam material, paper, cloth, or non-woven fabrics, covering three sides of its outer surface in the longitudinal direction thereof, holds the opposite ends of the applicator part 12 in fitting grooves 13 formed one each on the opposite sides of the prop 11, and fixes the applicator part 12 to a prescribed width with fitting bars 14. In the applicator prop 11, a guide chamber 15 for the contents of the aerosol container is formed in the direction of length on the inner surface of the applicator part 12, the nozzle 7 of the aerosol container 1 is connected to the upper end of the guide chamber 15. A guide prop 17 of a cylindrical form is inserted into the guide chamber 15 between the inner surface of the guide chamber 15 and a flow space 16 for the contents of the aerosol container. An injection orifice 18 of the aforementioned nozzle 7 is disposed opposite the central part of one upper lateral side end of the guide prop 17.

In the apparatus constructed as described above, when the pushbutton 6 is depressed to spurt the contents of the aerosol container 1 through the nozzle 7, substantially all of the contents spurted out the nozzle 7 collide against the aforementioned upper lateral side end of the guide prop 17 and only a portion of the spurted contents are directly advanced through the inner surface of the guide chamber 15 and the flow space 16 to be absorbed in the upper portion of the applicator part 12 and thus rendered applicable. The remaining greater part of the spurted contents partly impact on the guide prop 17, flow down the flow space 16, are forced by subsequently spurted contents into contact with the inner surface of the applicator part 12 and absorbed therein. Consequently, the contents are uniformly dispersed throughout the entire surface of the applicator part 12 disposed in the vertical direction of the aerosol container 1 and adapted to possess a wide surface area.

Figure 4:
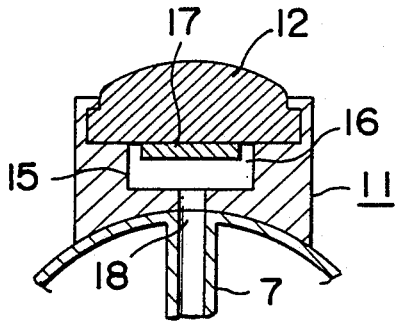
FIG. 4 and FIG. 5 are lateral cross sections illustrating modifications to the guide inlet portion of FIG. 3.
Figure 5:
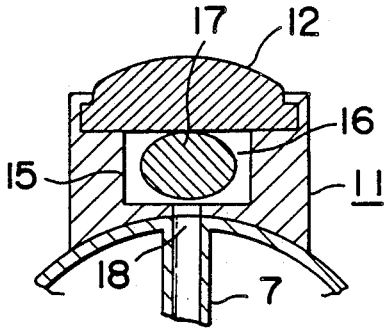

In the embodiment described above, the applicator part 12 is in the form of a sheet and the applicator prop 11 is covered by this applicator part 12 on three sides in the longitudinal direction of the outer surface thereof, holds the opposite ends of the applicator part 12 in the fitting grooves 13 formed on the opposite sides thereof, and fixes the applicator part 12 to a prescribed width with fitting bar 14. In a modification of this embodiment, the applicator part 12 may be produced in the form of a plate having an outer surface curved outwardly and this plate-shaped applicator part 12 may be fitted fast to the front side of the applicator prop 11 as illustrated in FIG. 4 and FIG. 5.

In the foregoing embodiment, the guide prop 17 is in a cylindrical form. In a modification of this embodiment, it may be in the form of a flat plate or in the form of a depressed cylinder having an elliptical cross section as illustrated in FIG. 4 and FIG. 5.

In the embodiment described above, the release of the spurted contents is effected by the depression of the pushbutton 6. When the container is a squeeze bottle, the release of the contents may be effected by squeezing the barrel 2 of the bottle. Where an aerosol unit is used, a continuously spurting mechanism capable of continuously spurting the contents may be adopted. Otherwise, the applicator prop 11 may be adapted so that the spurting of the contents will be obtained by pressing the applicator prop 11 against the object under treatment and enabling the pressure thus applied to bear directly upon the stem 5.

Figure 6:
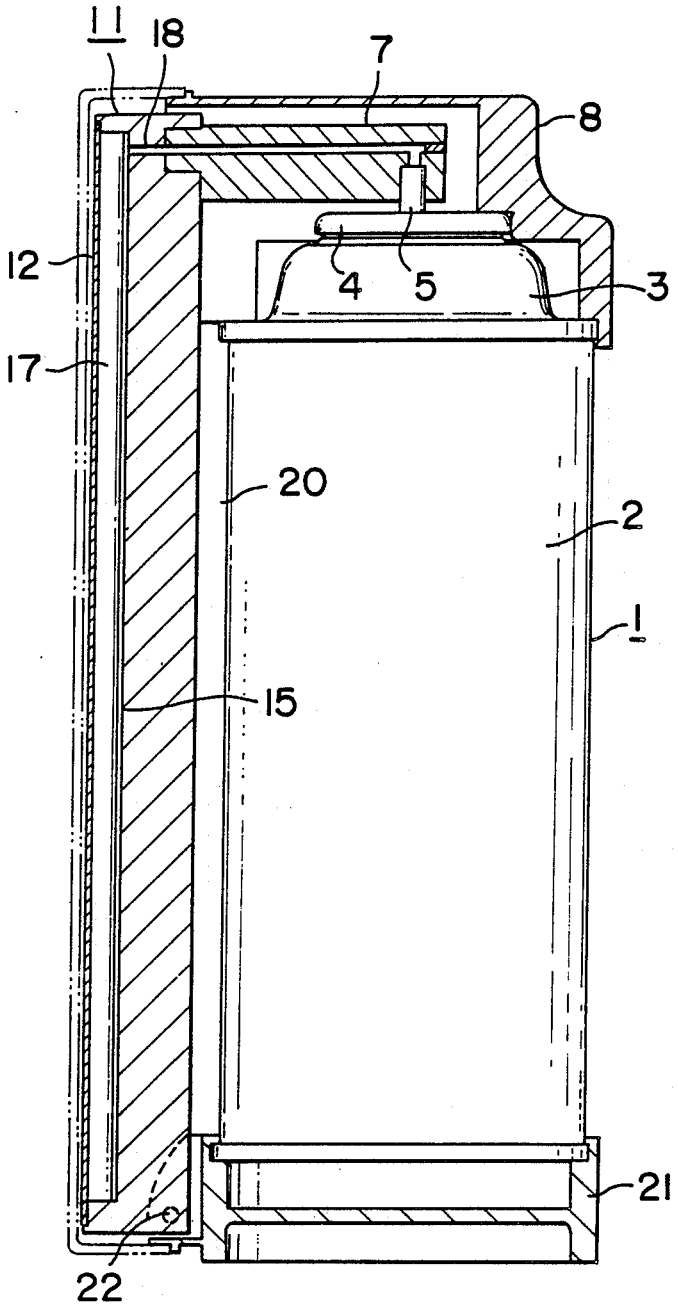
FIG. 6 is a cross section of the apparatus of FIG. 1.

Now, the forced release of the contents by the pressure of the applicator prop 11 will be described more specifically with reference to FIG. 6. The stem 5 of the aerosol unit is connected to a slanted operating valve adapted to spurt the contents when it is pressed in a direction intersecting the axial direction of the stems. The applicator prop 11 which is connected to this stem 5 through the nozzle 7 spaced from the aerosol container 1 by a suitable space of movement 20. Further, one side of the lower end of the applicator prop 11 is pivotally supported on the base seat 21 with a fixing shaft 22. In the apparatus constructed as described above, when the applicator 12 is pressed against the object under treatment, the applicator prop 11 is moved in the direction of the aerosol container 1 with the fixing shaft 22 as a fulcrum to slant the stem 5 through the medium of the nozzle 7. Consequently, the valve of the aerosol container 1 is released to spurt the contents through the nozzle 7 and, by the aforementioned operation, cause the spurted contents to be dispersed throughout the entire surface of the applicator part 12.

Figure 7:
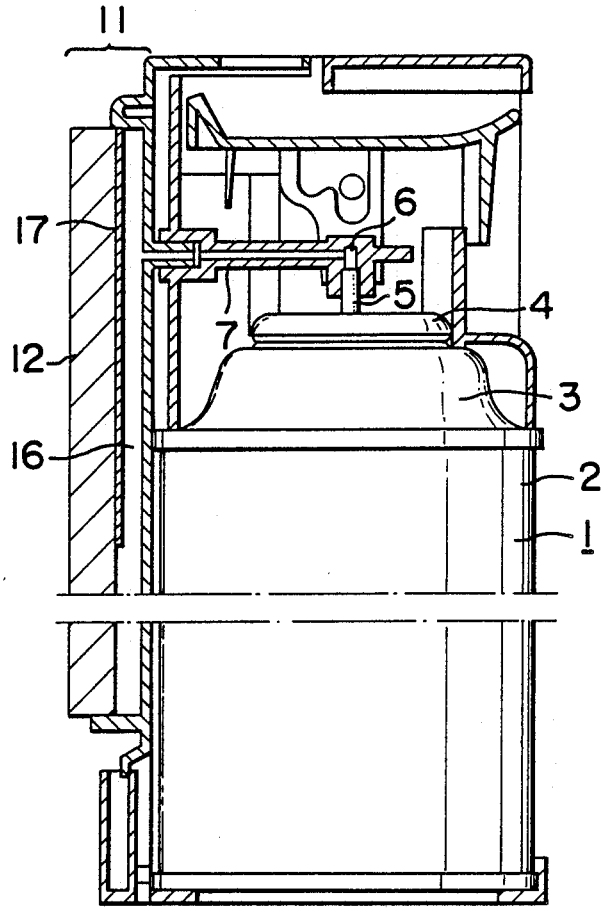
FIG. 7 is a partially omitted cross section of another embodiment of an application type aerosol apparatus of the present invention.

Another similar embodiment according to the present invention is shown in FIG. 7. FIG. 7 is a partially omitted cross section of the application type aerosol apparatus. In the drawing, an aerosol container 1 has an applicator prop 11 fixed to substantially its entire length in the vertical direction. The applicator prop 11 has a sheetlike applicator part 12 made of absorbent material such as felt, open-cell foam material, paper, cloth, or non-woven fabric and so forth, or an applicator part made of non-absorbent material so as to distribute the liquid contents to the whole of the applicator part 12, and a flow space 16 formed inside of the applicator part 12, with connection to a nozzle.

In the apparatus constructed as described above, when a pushbutton 6 is depressed to spurt the contents of the aerosol container 1 through the nozzle 7, the contents collide against a guide prop 17, are guided by a flow space 16 to flow down therein, being pressed by the contents subsequently spurted through the nozzle 7, whereby the contents are uniformly dispersed throughout the entire surface of the applicator part disposed in the vertical direction of the aerosol container 1 so as to make the desired application.

Due to the construction described above, the present invention has the following effects. Since the applicator prop which has the applicator part fixed in the longitudinal direction on the outer surface thereof is fixed in the vertical direction on the outer side of the aerosol container, the apparatus enjoys a wide area of application. Since the spurting nozzle of the aerosol container or the guide inlet connected to the stem is positioned opposite the guide prop inside the guide chamber, substantially all of the contents spurted through the spurting nozzle collide against one upper lateral side end of the guide prop and only a small portion of the spurted contents are absorbed directly by the applicator part through the medium of the inner surface of the guide chamber and the flow space of the contents and rendered applicable. The remaining greater part of the spurted contents lands on the guide prop, flows down the flow space, and disperses itself uniformly throughout the entire surface of the applicator part of large surface area. As a result, the applicator part is allowed to assume a large surface area for the application of the contents and is enabled to apply the contents to a surface of large area with high efficiency.

Figure 8:
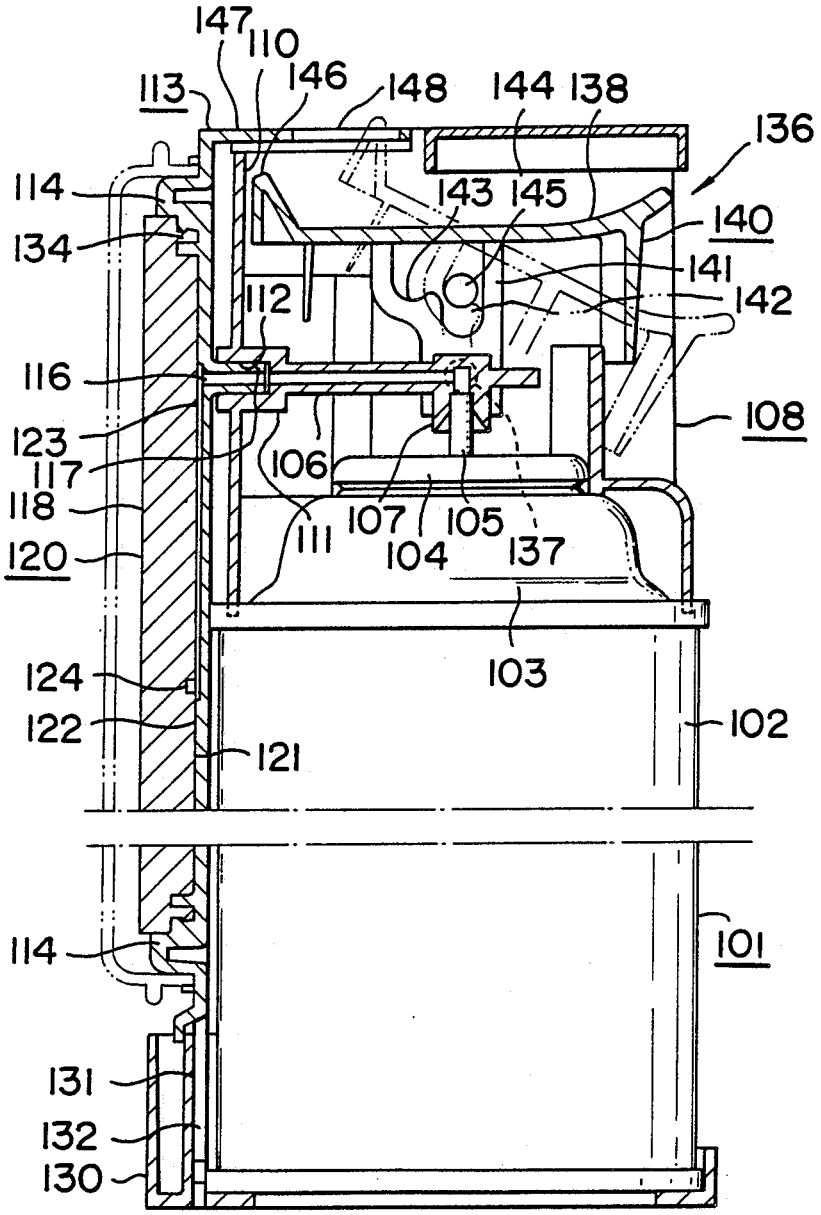
FIG. 8 is a partially omitted cross section of another embodiment of an application type aerosol apparatus of the present invention.
Figure 9:
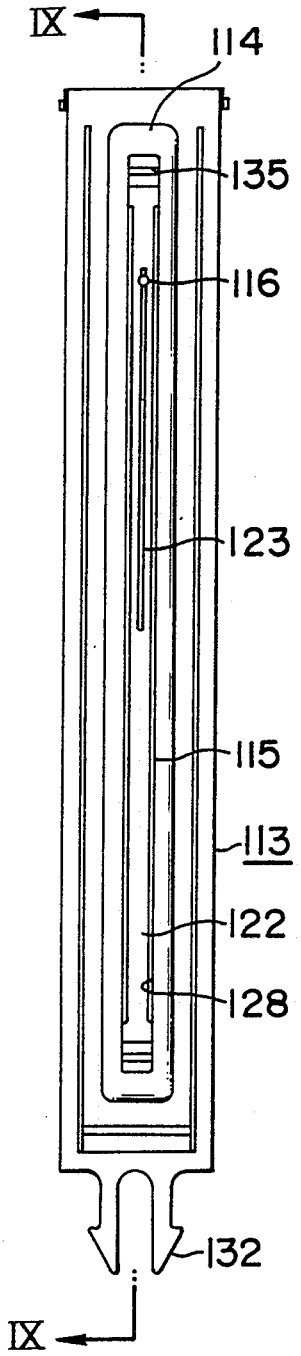
FIG. 9 is a front view of the receptacle frame shown in the diagram of FIG. 8.
Figure 10:
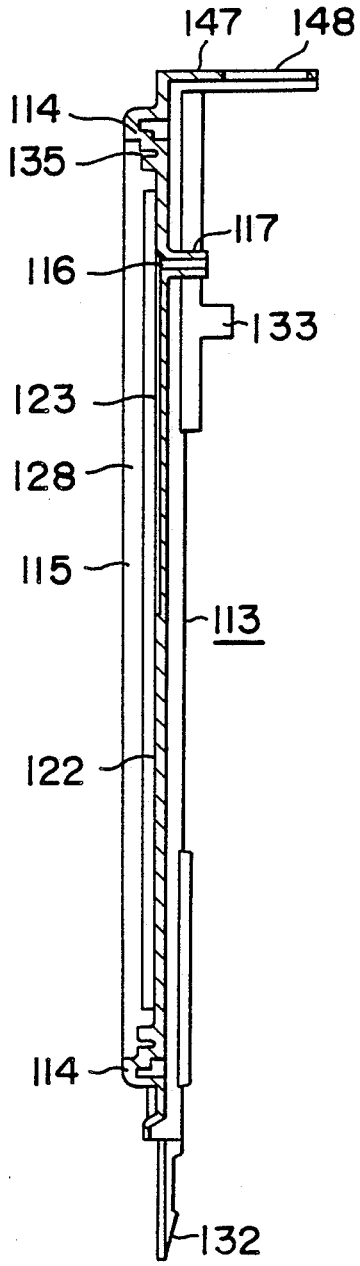
FIG. 10 is a cross section taken along the line IX—IX in the diagram of FIG. 9.
Figure 11:
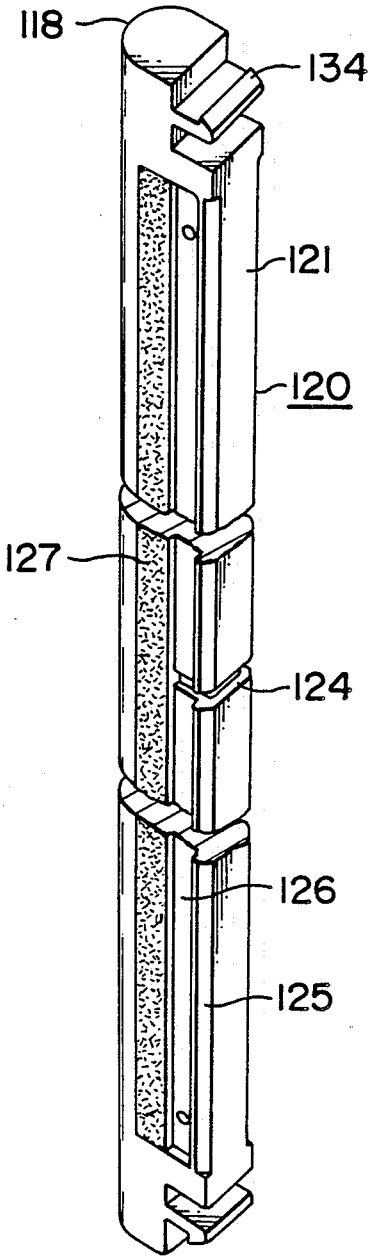
FIG. 11 is a partially omitted perspective diagram illustrating an applicator prop.
Figure 12:
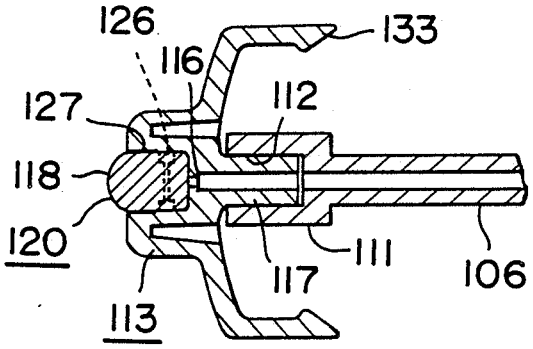
FIG. 12 is a lateral cross section of a connecting pipe keeping a receptacle frame and an applicator prop in a joined state.

Now, further embodiments of this invention will be described below with reference to the accompanying drawings. FIG. 8 is a partially omitted cross section of another embodiment of an application type aerosol apparatus of this invention. FIG. 9 is a front view of a receptacle frame or application prop in the apparatus illustrated in FIG. 8. FIG. 10 is a cross section taken along the line IX—IX shown in the diagram of FIG. 9. FIG. 11 is a partially omitted perspective view of the applicator part. FIG. 12 is a lateral cross section of the portion of a connection pipe serving to keep the receptacle frame and the applicator part in a mutually fitted state.

In the diagrams, an aerosol container 101 has a mounting cup 104 fixed to the upper end of a barrel 102 through the medium of a strap 103. A stem 105 is thrust out of this mounting cup 104. To this stem 105 is connected a pushbutton 107 having a bendable guide tube 106 protruded on one side thereof. The stem 105 is adapted so that when the pushbutton 107 is pushed, a valve mechanism stowed inside is opened and the contents of the aerosol such as insecticide, paint, cleaner, or wax prepared in an applicable form are consequently spurted through the guide tube 106. The leading end of the guide tube 106 is fixed to a lateral wall 110 of a one-touch cap 108 fixed to the upper end of the aerosol container 101. On the outer surface of the fixing part 111 a depression 112 is formed for insertion. A receptacle frame or application prop 113 is joined to the outer lateral side of the one-touch cap 108 and the aerosol container 101 along their combined length in the axial direction to the lower end of the aerosol container 101. This receptacle frame 113 is formed of a trough-shaped depressed part 115 having the opposite sides in the longitudinal direction thereof closed with opposite side walls 114. A connection tube 117 communicating with a guide inlet 116 opening into the trough-shaped depressed part 115 projects out of the rear side. This connection tube 117 is detachably connected to the depression 112 for insertion. Through this connection tube 117, therefore, the aerosol contents brought out through the guide tube 106 are introduced into the trough-shaped depression 115. This trough-shaped depression 115 contains a non-absorbent applicator part 120 with a smooth outer arcuate surface or application face 188. On the bottom surface 122 of the trough-shaped depression 115 contacted intimately with the rear side 121 of the applicator part 120, a groove or guide chamber 123 communicating with the guide inlet 116 is formed as far as the middle part in the direction of length of the trough-shaped depression 115. A notch 124 is formed in the rear side 121 of the applicator part 120 at the position corresponding to the leading end part of this groove 123. A dispersion groove 126 communicating with this notch 124 is formed in the direction of length of the lateral side 125 of the applicator part 120. On the lateral side 125 of the applicator part 120 continuing into the dispersion groove 126 and on the applicator prop 120 side, fine surface irregularities 127 are formed resembling the pattern of aventurine. Consequently, a small flow space for the aerosol contents is formed along the inner wall 128 of the lateral wall of the receptacle frame 113. This flow space occurs further between the aforementioned groove 123 and the rear side 121 of the applicator part 120, between the notch 124 and the bottom surface 122 of the receptacle frame 113, and between the dispersion groove 126 and the inner surface 128 of the lateral wall of the receptacle frame 113. Thus, through this flow space, the aerosol contents can be distributed to the application face 118 of the applicator part 120. The receptacle frame 113 is formed, as described above, so as to be positioned in the direction of length on one lateral side of the aerosol container 101. The connection of this receptacle frame 113 to the aerosol container 101 is accomplished by causing an engaging claw 132 protruding from the lower end of the receptacle frame 113 to be inserted and fitted into the fitting groove 131 of the fixing member 130 fixed to the lower bottom of the aerosol container 101 and, at the same time, causing a pinching fixing claw 133 projecting on the opposite sides in the direction of the upper end of the receptacle frame 113 to be engaged with engaging depressions (not shown) on the outer lateral side of the onetouch cap 108 fixed to the upper end of the aerosol container 101. The fast union of the receptacle frame 113 and the applicator part 120 is effected by causing engaging projections 134 formed one each at the upper and lower ends of the rear side 121 of the applicator part 120 to be inserted into engagement with engaging parts 135 of the receptacle frame 113.

It naturally is possible to advance the aerosol contents to the applicator prop 120 simply by depressing the pushbutton with a finger. In the present embodiment, the advance of the aerosol contents is effected with a continuous valve opening mechanism 136. This continuous valve opening mechanism 136 is formed by providing the pushbutton 107 on the opposite sides thereof with operating lever 140 having the lower ends thereof pivotally supported on shaft fulcrum 137. The upper end of operating lever 140 comprises a depression top plate 138, perforating oblong groove 142 in the vertical direction in support wall 141 of the operating lever 140. An engaging depression 143 on the lateral sides of the oblong groove 142 is formed to communicate with the oblong groove 142. Further, an engaging projection 145 is fixed on the inner sides of outer walls 144 of the one-touch cap 108 and is inserted into the oblong groove 142. The engaging projection 145 and the shaft supporting part 137 of the operating lever 140 in the condition not involving the spurting of the aerosol contents are separated by a distance smaller than the distance between the shaft supporting part 137 and the engaging depression 143. This difference of distance constitutes the stroke of the depression exerted upon the pushbutton 107 for the spurting of the aerosol contents. The support wall 141 on which the aforementioned oblong grooves 142, and the engaging depression 143 is formed on the opposite sides of the pushbutton 107, having the upper end thereof connected to the depression top plate 138 so as to ensure accurate depression of the pushbutton 107. Further, a display unit 146 is projected from the upper side at one end of the depression top plate 138. In a covering plate 147 of the receptacle frame 113 protruding upwardly from the one-touch cap 108, there is formed a display opening 148 which permits the display unit 146 to be projected only during the operation of the continuous opening valve of the operating lever 140 and does not permit the projection of the display unit during the absence of the operation of the continuous opening valve.

In the apparatus constructed as described above, when the depression top plate 138 of the operating lever 140 is depressed, the pushbutton 107 is forced down through the medium of the shaft fulcrum 137 to release the valve mechanism and advance the aerosol contents to the guide tube 106. When the depression top plate 138 is relieved of the depression, the pushbutton 107 is elevated by the spring of the valve mechansim and the spurting of the contents to the guide tube 106 is interrupted. The advanced aerosol contents are allowed to flow down the flow space defined between the guide tube 106, the guide inlet 116, the groove 123, the notch 124, the dispersion groove 126, and the fine surface irregularities 127 on one part and the opposed external faces of the receptacle frame 113 and the applicator part 120 on the other part. As the application face 118 is caused to assume a lower horizontal position relative to the apparatus as a whole, the aerosol contents are dispersed uniformly to the application face and enabled to be applied uniformly to the object under treatment. The aforementioned intermittent spurting of the aerosol contents suffices for the purpose of application of a small amount of the active agent on a small area. For the application of a large amount of the active agent on a large area, it becomes necessary to spurt the aerosol contents continuously. To effect the continued spurting of the aerosol contents, the operating lever 140 is depressed to start the spurting and then it is set aslant opposite the direction of the spurting as indicated by the two-dot one-dash line in FIG. 8 so that the engaging projection 145 is brought into engagement with the engaging depression 143 formed continuously along with the oblong groove 142. While the engaging projection 145 is in the condition not involving the spurting of the aerosol contents, it is held inside the oblong groove 142 of the operating lever 140 and is not allowed to produce any effect upon the operating lever 140. Since the distance between the shaft fulcrum 137 and the engaging projection 145 while the pushbutton 107 is in the condition involving no spurting of the aerosol contents is smaller than the distance between the shaft fulcrum 137 and the engaging depression 143 and this difference of distance constitutes the stroke of depression the pushbutton 107 requires to initiate the spurting of the aerosol contents, the engagement established between the engaging depression 143 and the engaging projection 145 keeps the pushbutton 107 depressed and permits continuous spurting of the aerosol contents. This continued spurting entails the motions of engaging the engaging projection 145 with the engaging depression 143 disposed along the oblong groove 142 and lowering the shaft fulcrum 137. Consequently, the operating lever 140 serving as the continuous valve opening mechanism 136 is moved out of the position it assumes during the absence of the spurting of the aerosol contents. Particularly, the display unit 146 protruding from one end of the depression top plate 138 shifts its position greatly so much as to thrust out of the display opening 148 of the covering plate 147 of the one-touch cap 108 to indicate clearly that the continuous valve opening mechanism 136 is now at work. A red or fluorescent color applied on the upper end of the display unit 146 aids in greatly adding to the conspicuousness of the display of the operational status.

As described above, this invention enables the aerosol contents brought in through the guide inlet to exude from the outer face of the applicator prop by causing the guide inlet connected to the stem of the aerosol container to open into the trough-shaped receptacle frame closed at the opposite sides in the longitudinal direction thereof and, at the same time, allowing the applicator prop made of non-absorbent material to be fitted fast in the receptacle frame with the flat smooth surface of the applicator part projected on one side thereby giving rise to the flow space of the aerosol contents between the applicator prop and the receptacle frame. Thus, the applicator part exerts extremely low frictional resistance upon such flexible materials as carpets and fabrics and, therefore, it may be strongly pressed against a flexible object of large thickness such as a carpet so that the aerosol contents will be applied to the deep recesses of the object.

The application type aerosol apparatus to be used for this invention is not necessarily limited to the embodiments described above. The shape of the applicator part, for example, may be freely selected to suit the purpose of use and the area of the object to be treated. When the apparatus is adopted for the application of the aerosol contents on articles of furniture and clothes which have large areas, it proves highly efficient because the applicator part extends substantially over the entire length of the aerosol container. When the apparatus is intended for articles of small areas, the applicator part formed in part of the entire length proves convenient.

Since the aerosol contents are in a liquid state while passing the guide section, the guide section may be in any desired shape. It is only required to advance the aerosol contents to the applicator part.

The gas spurting outlet, for example, may be in the form of a pipe extended to the lateral side of the container and provided at suitable positions with spurting orifices and the applicator prop may be attached to this pipe.

Further, in the apparatus constructed as illustrated in the diagrams, a guide bar adapted to regulate the movement of the aerosol contents may be inserted therein. Although the guide prop is effective in guiding the spurted aerosol contents to the guide section it is not an essential component when the applicator prop is made of non-absorbent material or when the upper part of the guide bar is opposite to the spurting orifices of the nozzle.

Examples of the solvent for the active agent held in the aerosol contents include alcohols, ketones, ethers, petroleums, halogenated hydrocarbons, fluorohalogenated hydrocarbons, and other various substances. The solvent may be selected to suit the purpose of use. Petroleum-based solvents generally excel in their ability to facilitate absorption of active agents by the treated surfaces but are liable to wet the surfaces. Where the objects to be treated require the active agents to dry quickly and to be safe, use of a non-flammable solvent or mixture thereof selected from the group consisting of lower alcohols, ethers, and fluorohalogenated hydrocarbons having boiling points not exceeding 100° C. proves desirable. Any of the conventional propellants such as those popularly adopted for spray aerosols may be used as the propellant. To ensure safety against fire, a propellant mixed with a flame-retardant gas should be used.

Examples of the active ingredients to be included in the aerosol contents include such furniture cleaners as Carnauba wax, Ceresine wax, and Silicon 200, antistatic agents or static electricity removers containing sulfates of higher alcohols and organic amine salts of phosphates of higher alcohols, waterproofing agents such as stearamide methylpyridinium chloride, octadecylethylene urea, and silicone resins, softening agents and polishing agents for leather articles using sperm alcohol, liquid paraffin, and glycerin fatty acid esters as principal components, polishes, fungifuges such as sorbic acid and dehydroacetic acid, deodorants such as glycerol and hexachlorophene, glass cleaners containing straight-chain sodium alkylbenzenesulfonate and potassium pyrophosphate, stain removers and defrosting agents using alcohols and diethylene glycol, rust-proofing lubricants and lubricants for furnishings formed of metal soaps of sorbitan mono-leate and naphthenic acid, fungicidal deodorants for sick rooms such as cresol and benzalkonium chloride, hair care agents using sodium salts of sulfate of lauryl ethoxylate as a main component, salycilic acid, acrinol, and invert soap. Examples of insecticides and miticides include various pyrethroid compounds such as phenothrin, permethrin, resmethrin, 3'-phenoxybenzyl 2,2,3,3-tetramethylcyclopropane carboxylate, allethrin, furamethrin, empenthrin and other proprietary formulations, synergists for pyrethroid compounds such as IBTA, S-421, lethane 384, piperonyl bytoxide, synepyrin 222, and synepyrin 500 available in proprietary formulations, various organophosphorus insecticides, sumithion, diazinon, various carbamate insecticides such as MTMC, and MPMC, other insecticides, and repellents such as Deet and Benzyl Benzoate. Combined use of such active ingredients with fungicides and bactericides is also permissible. Insecticides and repellants containing pyrethroid type compounds and used for protection of toy animals and stuffed animals are also included. These examples are cited purely for the purpose of illustrating and are not meant to limit the active ingredients in the aerosol contents, which are suitably determined, depending on the purpose of use and the condition of application, for example.

For extermination of various species of house dust mites infesting carpets, application of a pyrethroid compound at a rate of 0.5 mg to 5 g per $m^2$, possibly in combination with a pyrethroid synergist applied at a rate of 0.5 mg to 5 g sufficies. This application is highly safe as well.

This invention is directed particularly to the protection of carpets and floor coverings. It is effective in exterminating various species of house dust mites, cheyletidae, acaroid mites and wool harmful insects, such as case bearing clothes moths, webbing cloth moths, varied carpet beetles, and black carpet beetles infesting carpets at all stages of their growth, i.e., eggs, larvae, nymphae, imagoes. In addition, it is effective in exterminating house ticks, deathwatch and drugstore beetles, bethylid wasps, cockroaches, and harmful cereal insects such as rice weevils, fleas, lice and bedbugs.

This invention is not particular at all about the kind of carpet or floor covering to be treated. It is equally effective in treating Oriental rugs, woolen carpets, looped carpets, fur cushions such as of mouton, and all sorts of floor coverings, without reference to the depth of yarn or hair.

This invention is quite unique in the sense that it adopts an application type aerosol apparatus devised to be used safely (in terms of freedom from toxicity and fire) indoors. The application face is of freely selected form and material, ensuring efficient and uniform application of the aforementioned active agent.

Now, the present invention will be described more specifically below with reference to working examples. It should be noted, however, that the following examples are not limitative of this invention.

EXPERIMENT 1

(Test for exterminating effect)

Squares of 7 cm cut from a carpet were each infested with about 200 house dust mites and, after being left to stand for one day, were treated with varying agents by the method of this invention. Each square of carpet thus treated was placed in a glass container and left standing at 25° C. with 65% humidity. After standing one week under these conditions, the square was heated to drive out surviving mites. The ratio of extermination was determined by counting the surviving mites thus driven out of the treated square.

TABLE 1

| | Method of extermination | | | | | Effect of treatment |
|---|---|---|---|---|---|---|
| | Contents | | | | | Rate of extermination after standing one week % |
| | Dose of agent used (mg/$m^2$) | | Solvent | Propellant | Method of application | |
| 1 | d-resmethrin<br>IBTA | 50<br>200 | Flon 112<br>n-pentane | Flon 12<br>LPG | Spread Aerosol Method | 100 |
| 2 | d-phenothrin<br>lethane 384 | 50<br>100 | Ethanol<br>Flon 113 | Flon 12<br>Flon 114 | Spread Aerosol Method | 100 |
| 3 | Sumithion | 100 | Petroleum | LPG<br>DME | Spread Aerosol Method | 100 |
| 4 | permethrin<br>Deet | 40<br>200 | Flon 112<br>Methyl chloroform | LPG | Spread Aerosol Method | 100 |
| 5 | d-resmethrin<br>synepyrin<br>" | 100<br>500<br>300 | Petroleum | LPG<br>DME | Spray Method | 55 |
| 6 | MTMC<br>Benzyl Benzoate | 100<br>200 | Ethanol<br>Flon 113 | LPG<br>Flon 114 | Spray Method | 48 |
| 7 | — | | Methyl ethyl ketone | DME | Spread Aerosol | 0 |

As a control, the conventional spray method was tried at the same time (Run Nos. 5 and 6).

The results of the test indicate that in all the test runs by the spread aerosol method of this invention, the rates of extermination of house dust mites invariably was 100%, whereas in the test runs by the conventional spray method, the rates of extermination were very low because the agents could not be made to reach the roots of yarns of carpet. In the formulation of Run No. 3 using petroleum as a solvent, the applied agent did not dry as quickly as desired and tended to make the surface of treated carpet stickly.

EXPERIMENT 2

(Test for preventive effect)

Squares of 7 cm cut from a carpet were treated with a varying agent by the method of this invention and, after standing one day were infested with about 200 house dust mites. Then by following the procedure of Example 1, the rate of extermination of mites after standing one week was determined.

TABLE 2

| | Method of extermination | | | | | Effect of treatment |
|---|---|---|---|---|---|---|
| | Contents | | | | | Rate of extermination after standing one week |
| | Dose of agent used (mg/m²) | | Solvent | Propellant | Method of application | % |
| 1 | d-resmethrin | 50 | Ethanol | Flon 12 | Spread Aerosol | 100 |
| | IBTA | 100 | Flon 112 | DME | Method | |
| | Deet | 100 | | | | |
| 2 | Diazinon | 100 | Ethanol | LPG | Spread Aerosol | 100 |
| | empenthrin | 100 | Petroleum | | Method | |
| 3 | d-phenothrin | 50 | Flon 11 | Flon 12 | Spread Aerosol | 100 |
| | S-421 | 100 | Propanol | LPG | Method | |
| 4 | permethrin | 100 | Ethanol | DME | Spray Method | 64 |
| | d-allethrin | 50 | Flon 113 | | | |
| 5 | Sumithion | 100 | Flon 112 | Flon 12 | Spray Method | 70 |
| | Benzyl | 100 | Heptane | LPG | | |
| | Benzoate | | | | | |
| 6 | — | | Flon 113 | LPG | Spread Aerosol | 0 |
| | | | Petroleum | | Method | |

TABLE 3

| | Method of application | | | | | Effect | | |
|---|---|---|---|---|---|---|---|---|
| | Contents | | | | | | | |
| | Dose of active agent used (mg/m²) | | Solvent | Propellant | Method | A | B | C |
| 1 | Carnauba wax | 300 | Naphtha | Flon 12 | Spread Aerosol | ++++ | ++++ | ++++ |
| | Carnauba wax | 200 | Water | | Method | | | |
| | Silicone | 200 | | | | | | |
| | Silcone | 500 | | | | | | |
| 2 | Crude scale wax | 500 | Flon 12 | Flon 12 | Spread Aerosol | ++++ | ++++ | ++++ |
| | Ethyl celulose | 200 | Propanol | LPG | Method | | | |
| 3 | Carnauba wax | 300 | Methylene | DME | Spray | + | + | ++ |
| | Ceresin wax | 200 | chloride | | Method | | | |
| | Silicone | 200 | Ethanol | LPG | | | | |
| | Silicone | 500 | | | | | | |
| 4 | Ceresin wax | 200 | Cellosolve | Flon 14 | A circular | ++ | + | + |
| | Crude scale wax | 300 | acetate | | adapter is | | | |
| | Sorbitan | 500 | Flon 11 | LPG | attached to | | | |
| | Mono-oleate | | | | the spray nozzle | | | |

As a control, the conventional spray method was tried at the same time (Run Nos. 4 and 5).

The results of the test indicate that the treatment by the spread aerosol method of this invention was highly effective in preventing the carpet against infestation of mites and that the agents applied manifested high residual effects. In the test runs by the conventional spray method, although the preventive effects were relatively higher than the exterminating effects, they were not sufficient.

EXPERIMENT 3

(Test of furniture cleaner for effect)

To areas of 1 m² of the surfaces of articles of furniture smeared throughout with greasy dirt, varying cleaners were applied by using the application type aerosol apparatus of this invention.

As a control, the same treatment was effected by the conventional spray method and the method using an apparatus having a doughnut-shaped adapter of felt attached near the spray nozzle. After the treatment, the surfaces were examined in terms of cleanliness (A), degree of dispersion of active agent in the surrounding area (B), and duration of treatment (C). The results of the test were rated by the four-point scale, wherein ++++, +++, ++, and + denote gradually falling ranks, starting from the highest degree of cleanliness in (A), the smallest degree of dispersion of active agent in (B), and the shortest duration of treatment in (C), respectively.

The results of the tests indicate that the spread aerosol method of application (Run Nos. 1 and 2) according to this invention far excelled the conventional methods, i.e., the spray method (Run No. 3) and the method using the apparatus having a doughnut-shaped adapter of sponge attached near the spray nozzle (Run No. 4), in terms of cleanliness due to the treatment, prevention of dispersion of applied agent in the surrounding area, and duration of treatment.

EXPERIMENT 4

(Test of woolen article for fungicidal and deodorizing effect)

Figure 13:
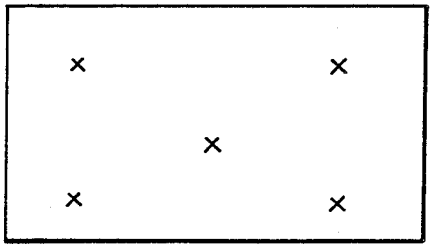
FIG. 13 is a diagram showing the positions in which fungal spores were transplanted on a used blanket in Experiment 4.

Molds growing in a closet were incubated and transplanted to five varying spots on a blanket (0.5 m in width and 1.5 m in length) at the positions indicated by the mark X in FIG. 13. The blanket was then left standing under humidity of 100% for two weeks.

To the blanket thus prepared, varying active agents were applied by the method of this invention and the conventional methods, to examine fungicidal and deodorizing effect, degree of dispersion of active agent (A), and duration of treatment (B). In the treatments by the conventional methods, the agents were sprayed at a distance of about 40 cm from the blanket surface.

The results of test were rated by the four-point scale, wherein ++++, +++, ++, and + denote gradually falling ranks, starting from the highest fungicidal and deodorizing effect, the smallest degree of dispersion of active agent, and the shortest duration of treatment, respectively.

TABLE 4

| | Method of application | | | | | Effect | | | |
|---|---|---|---|---|---|---|---|---|---|
| | Contents | | | | | | | | |
| | Dose of active agent used (mg/m²) | | Solvent | Propellant | Method | Fungicidal | Deodorizing | A | B |
| 1 | Benzalkonium Chloride | 200 | Isopropanol | Flon 12 Flon 11 | Spread Aerosol Method | ++++ | ++++ | ++++ | ++++ |
| | Perfume | 400 | | | | | | | |
| | Triethylene glycol | 1,000 | | | | | | | |
| 2 | Hexachlorophene | 300 | Ethanol | Flon 12 | Spread | ++++ | ++++ | ++++ | ++++ |
| | Perfume | 300 | Petroleum | DME | Aerosol | | | | |
| | Propyrene glycol | 1,500 | | | Method | | | | |
| 3 | Benzalkonium Chloride | 200 | Kerosine Isopropanol | Flon 11 LPG | Spray | + | ++ | + | ++ |
| | Perfume | 400 | | | | | | | |
| | Triethylene glycol | 1,000 | | | | | | | |
| 4 | Alkoxymethyl pyridinium chloride | 200 | Ethanol | DME LPG | A circular spongy adaptor is provided at the spray nozzle. | + | ++ | ++ | + |
| | Perfume | 400 | | | | | | | |
| | Propylene glycol | | | | | | | | |

The results of the tests indicate that the spread aerosol method of application (Run Nos. 1 and 2) according to this invention far exceeded the conventional methods (Run Nos. 3 and 4) in terms of fungicidal and deodorizing effects, prevention of dispersion of active agent in the surrounding area, and duration of treatment.

While the spray method was unable to apply the active agent to the roots of the yarns of the blanket, the method of this invention was able to distribute the active agent throughout the entire surface of the blanket.

EXAMPLE 1

In a mixed solvent of ethanol and F-113, 1.0 g of d-resmethrin and 2.0 g of synepyrin 500 were dissolved. The solution was placed in a spread type aerosol container and a propellant was added thereto under pressure, to produce a spread aerosol.

About one quarter of the entire volume of the aforementioned aerosol was applied throughout the entire surface of a carpet covering six tatamis (straw mattings) and suffering from heavy growth of house dust mites. After standing one week, the blanket was examined for rate of survival of mites. The rate was less than 2%.

EXAMPLE 2

A spread aerosol was prepared by following the procedure of Example 1, except that 1.5 g of d-phenothrin and 2.0 g of benzyl benzoate were used. About one fifth of the total volume of the aerosol thus produced was applied throughout the entire surface of a pure woolen carpet covering four-and-a-half mats. After standing one day, 100 larvae of moths and 200 eggs of moths were transplanted to the blanket. After standing one week the carpet was examined for surviving larvae of moths. Less than two moth larvae survived. At the examination after standing one month, hatched moths were not observed. Thus, the exterminating method according to the present invention showed a high effect against wool harmful insects.

EXAMPLE 3

In 80 g of a mixed solvent of isopropanol and npropanol, 5.0 g of diethylene glycol was dissolved. The solution was placed in a spread aerosol container. A propellant was added thereto under pressure. Consequently, there was produced a spread aerosol.

About one fifth of the total volume of the aerosol thus produced was applied to the entire surface of a completely blurred window glass (about 3 m²). Immediately, the window glass became thoroughly clean.

EXAMPLE 4

A spread aerosol was prepared by following the procedure of Example 1 and using 8 g of sodium high-alkylbenzene sulfonate and 2 g of potassium pyrophosphate. About one quarter of the total volume of the spread aerosol thus produced was applied throughout the entire surface of a carpet covering four-and-a-half mats and smeared with greasy food.

The treatment involved no dispersion of the active agent and lasted for a short time (about 15 minues). It resulted in thorough removal of the smear.

It is to be understood that the foregoing description is illustrative only and that various modifications and alterations thereto would be readily apparent to one of ordinary skill in the art. This description is not intended to limit the scope of the invention, which is defined by the claims set forth below.

What is claimed is:

1. An application apparatus comprising:

an aerosol container having an outlet stem;

an application prop carried by said aerosol container, said application prop having a first longitudinal surface in direct contact with an external longitudinal side of said aerosol container and a second longitudinal surface opposite said first longitudinal surface, said second longitudinal surface having a longitudinally depressed portion provided therein;

an elongate absorbent applicator part disposed on said second longitudinal surface of said application prop, said applicator part having an inner surface facing said application prop and an outer surface opposite said inner surface, said outer surface forming an application face;

an elongate guide chamber defined by said inner surface of said applicator part and said longitudinally depressed portion of said application prop; and a guide inlet in fluid communication with said outlet stem and said guide chamber such that any contents of said aerosol container can pass from inside of said container through said outlet stem and said guide inlet to said guide chamber;

wherein any contents in said guide chamber can exude from said guide chamber by exuding through said inner surface of said applicator part to said application face.

2. An application apparatus of claim 1, further comprising an elongate guide prop disposed along the inner surface of said applicator part in said guide chamber so as to permit contents in said guide chamber to exude from said guide chamber along longitudinal sides of said guide prop to said application face of said applicator part.

3. An application apparatus of claim 2, wherein said guide prop is an elongate member in the form of a cylinder.

4. An application apparatus of claim 2 wherein said guide prop is an elongate member in the form of a depressed cylinder having an elliptical cross section.

5. An application apparatus of claim 2 wherein said guide prop is an elongate member in the form of a flat plate.

6. A method for applying the contents of an aerosol container to a target surface, comprising:

leading the contents from an outlet stem of an aerosol container through a guide inlet into an elongate guide chamber defined by a depressed portion of a longitudinal surface of an application prop and an inner surface of an absorbent applicator part, said application prop being directly disposed along an external longitudinal side of said aerosol container and said applicator part being disposed on said longitudinal surface of said application prop;

causing the contents to exude from said guide chamber through said inner surface of said applicator part to an application face of said applicator part, said application face comprising an outer surface of said applicator part; and applying said application face to a target surface thereby applying the exuded contents to said target surface.

7. The method of claim 6, wherein the contents strike an elongate guide prop located within said guide chamber adjacent said inner surface of said applicator part and said contents exude from said guide chamber along longitudinal sides of said guide prop to said application face of said applicator

8. An application apparatus comprising:

an aerosol container having an outlet stem disposed at a top end thereof, a bottom end opposite the top end, and a longitudinal side wall extending from the top end to the bottom end;

an application prop;

means for mounting the application prop on the container including a first means for mounting an upper end of the prop adjacent the top end of the container and a second means for mounting a lower end of the prop adjacent the bottom end of the container;

the application prop having a first longitudinal surface facing the side wall of said container and a second longitudinal surface opposite said first longitudinal surface, said second longitudinal surface having a longitudinally depressed portion provided therein;

an absorbent applicator part disposed on said second longitudinal surface of said application prop and extending from adjacent the top end of the container to adjacent the bottom end of container, said applicator part having an inner surface facing said application prop and an outer surface opposite said inner surface, said outer surface forming an application face;

a guide chamber defined by said inner surface of said applicator part and said longitudinally depressed portion of said application prop; and a guide inlet in fluid communication with said outlet stem and said guide chamber such that contents of said aerosol container can pass for inside of said container through said outlet stem and said guide inlet to said guide chamber;

wherein contents in said guide chamber can exude from said guide chamber by passing through said inner surface of said applicator part to said application face.

9. Application apparatus as in claim 8 wherein the application prop mounting means includes means responsive to the application of force to the prop for discharging contents from the outlet stem of the container.

10. Application apparatus as in claim 9 wherein the prop mounting means includes means for pivotally mounting the lower end of the prop;

means for mounting the upper end of the prop for movement toward and away from the outlet stem; and means extending between the upper end of the prop and the outlet stem for moving the outlet stem to a contents releasing position in response to movement of the prop, for supplying the contents of the container to the guide channel of the applicator part.

11. An application apparatus as in claim 8 and further comprising a guide prop disposed in said guide chamber and extending substantially the length thereof, and being disposed adjacent the inner surface of the application prop.

* * * * *